US008894465B2

(12) United States Patent
McClintock et al.

(10) Patent No.: US 8,894,465 B2
(45) Date of Patent: Nov. 25, 2014

(54) ECCENTRIC MOTION TOY

(75) Inventors: Chris McClintock, Watkinsville, GA (US); Robert Karnick, Tampa, FL (US)

(73) Assignee: Kids II, Inc., Atlanta, GA (US)

( * ) Notice: Subject to any disclaimer, the term of this patent is extended or adjusted under 35 U.S.C. 154(b) by 195 days.

(21) Appl. No.: 13/457,734

(22) Filed: Apr. 27, 2012

(65) Prior Publication Data

US 2012/0302128 A1 Nov. 29, 2012

Related U.S. Application Data

(60) Provisional application No. 61/480,115, filed on Apr. 28, 2011.

(51) Int. Cl.

| | |
|---|---|
| ***A63H 17/00*** | (2006.01) |
| ***A63H 33/00*** | (2006.01) |
| ***A63H 11/02*** | (2006.01) |

(52) U.S. Cl.

CPC ..... *A63H 11/02* (2013.01); *A63H 33/005* (2013.01)

USPC ..... 446/431

(58) Field of Classification Search

USPC ..... 446/431

See application file for complete search history.

(56) References Cited

U.S. PATENT DOCUMENTS

| | | | | | |
|---|---|---|---|---|---|
| 563,489 | A | * | 7/1896 | Johnson | 428/16 |
| 1,554,730 | A | * | 9/1925 | Ives | 191/49 |
| 2,425,429 | A | * | 8/1947 | Hansen | 446/311 |
| 2,725,654 | A | * | 12/1955 | Kosikar | 428/16 |
| 2,793,454 | A | * | 5/1957 | Shoemaker | 428/16 |
| 3,200,538 | A | * | 8/1965 | Glass et al. | 446/191 |
| 3,526,103 | A | * | 9/1970 | Lieber | 63/23 |
| 3,565,736 | A | * | 2/1971 | Jason | 428/26 |
| 4,037,357 | A | * | 7/1977 | Monroe et al. | 446/311 |
| 4,308,686 | A | * | 1/1982 | Ikeda | 446/312 |
| 4,319,941 | A | * | 3/1982 | Brownell | 156/61 |
| 4,321,291 | A | * | 3/1982 | Brownell | 428/16 |
| 4,411,099 | A | * | 10/1983 | Cancel | 446/298 |
| 4,575,354 | A | * | 3/1986 | Wakayama et al. | 446/437 |
| 5,297,981 | A | * | 3/1994 | Maxim et al. | 446/437 |
| 5,356,326 | A | * | 10/1994 | Ting | 446/175 |
| D359,094 | S | | 6/1995 | Brovelli | |
| 5,492,584 | A | * | 2/1996 | Bateman | 156/207 |
| 5,533,920 | A | | 7/1996 | Arad et al. | |
| 5,941,755 | A | * | 8/1999 | Danielian | 446/312 |
| 5,964,639 | A | | 10/1999 | Maxim | |
| 6,227,933 | B1 | * | 5/2001 | Michaud et al. | 446/462 |
| 6,461,238 | B1 | * | 10/2002 | Rehkemper et al. | 463/6 |
| 6,579,145 | B1 | | 6/2003 | Maxim | |

(Continued)

*Primary Examiner* — Kurt Fernstrom
*Assistant Examiner* — Dolores Collins
(74) *Attorney, Agent, or Firm* — Alston & Bird LLP

(57) ABSTRACT

Various embodiments of the present invention are directed to a powered children's toy configured for movement along a support surface. According to various embodiments, the powered children's toy includes a drive system configured to impart a motive force on the children's toy that causes the toy to roll, bounce, shake, or otherwise move along an eccentric motion path when placed upon a support surface (e.g., a floor). Various embodiments of the drive system are configured to drive a rotating member about a movable rotation axis, thereby generating a varying motive force that causes eccentric movement along the support surface. This varying motive force assists in freeing the toy ball from obstacles encountered on a support surface (e.g., a wall or piece of furniture). In addition, the children's toy may include a power supply provided in a fixed position within the children's toy and configured for convenient user access.

25 Claims, 3 Drawing Sheets

(56) References Cited

U.S. PATENT DOCUMENTS

| | | | | |
|---|---|---|---|---|
| 6,733,149 | B1 * | 5/2004 | Chuang | 362/86 |
| 6,793,026 | B1 * | 9/2004 | De Fazio | 180/8.3 |
| 6,855,228 | B1 * | 2/2005 | Perini | 162/112 |
| 6,902,464 | B1 * | 6/2005 | Lee | 446/456 |
| 6,964,572 | B2 * | 11/2005 | Cesa | 434/258 |
| 6,976,899 | B1 * | 12/2005 | Tamanas | 446/178 |
| 6,977,111 | B2 * | 12/2005 | Yamaguchi et al. | 556/1 |
| 7,329,166 | B2 * | 2/2008 | Hatting et al. | 446/93 |
| 7,946,902 | B2 * | 5/2011 | Willett et al. | 446/383 |
| 8,025,551 | B2 * | 9/2011 | Torres et al. | 446/431 |
| 8,038,504 | B1 * | 10/2011 | Wong | 446/454 |
| D670,040 | S * | 10/2012 | Aboujaoude | D30/117 |
| 8,562,386 | B2 * | 10/2013 | Carlson et al. | 446/431 |
| 8,579,674 | B2 * | 11/2013 | Carlson et al. | 446/462 |
| 8,752,696 | B2 * | 6/2014 | Reidhaar | 198/780 |
| 2006/0079149 | A1 * | 4/2006 | Proch | 446/431 |
| 2006/0079150 | A1 * | 4/2006 | Filoseta et al. | 446/431 |
| 2007/0128976 | A1 * | 6/2007 | Accerenzi | 446/465 |
| 2012/0302128 | A1 * | 11/2012 | McClintock et al. | 446/431 |

* cited by examiner

ECCENTRIC MOTION TOY

CROSS-REFERENCE TO RELATED APPLICATIONS

This application claims priority from provisional U.S. Application No. 61/480,115 entitled "Eccentric Motion Children's Toy," which was filed on Apr. 28, 2011 and is herein incorporated by reference.

BACKGROUND OF THE INVENTION

1. Field of the Invention

Various embodiments of the present invention described herein generally relate to children's toys, particularly children's toys adapted for eccentric movement on a support surface.

2. Description of Related Art

Children's toys adapted for movement along a support surface are often configured for exhibiting unexpected and surprising motion characteristics in order to provide higher levels of interest and entertainment for young children. These toys are typically configured to roll, bounce, or vibrate along a seemingly random motion path, and are often referred to as "bumbling" toys. For example, existing toys include a powered toy ball—such as that disclosed in U.S. Pat. No. 5,297,981—that includes an internal motor configured to rotate about an axle fixed within the ball, thereby causing movement of the ball.

However, the motion characteristics of existing toy balls frequently result in the balls becoming stuck upon encountering an obstacle, such as a wall or a piece of furniture. The motion characteristics of these balls may also not be entertaining or otherwise suitable for young children. In addition, powered toy balls of this type often include a power source positioned in a location inconvenient for a user to access. For example, in the toy ball disclosed in the '981 patent, the toy ball's batteries are contained within a battery cover configured to rotate around the axle within the toy ball. As such, a user must perform a complex disassembly of the toy ball in order to access and replace the batteries. In addition to the inconvenient placement of the power source, the components of the drive system are exposed and vulnerable to damage during disassembly.

Accordingly, there is a need in the art for a powered children's toy configured for exhibiting improved motion characteristics. In addition, there is a need in the art for an improved children's toy having a power source located for convenient user access.

BRIEF SUMMARY OF THE INVENTION

Various embodiments of the present invention are directed to a powered children's toy configured for movement along a support surface. According to various embodiments, the children's toy comprises a housing defining an interior area and configured for rolling along the support surface, and a drive system positioned within the interior area and configured for driving a rotating member about a rotation axis. The drive system is configured such that the position of the rotation axis with respect to the housing changes as the rotating member rotates about the rotation axis, thereby imparting a motive force to the children's toy. According to certain embodiments, the motive force imparted by the drive system drives the children's toy in varying directions, thereby causing the children's toy to roll along an eccentric path on the support surface.

In various embodiments of the children's toy, the rotating member may comprise a weighted member and the drive system may comprise a motor configured for driving the weighted member about the rotation axis. For example, in certain embodiments, the drive system comprises a platform supporting the motor and the weighted member within the interior area, the platform being movably connected to the housing such that, as the weighted member rotates about the rotation axis, the platform tilts with respect to the housing. In other embodiments, drive system's rotating member comprises a motor configured to rotate about a driveshaft defining the rotation axis.

In addition, various embodiments of the present invention are also directed to a children's toy configured for rolling along the support surface and comprising: a housing defining an interior area and configured for rolling along the support surface, a drive system positioned within the interior area and configured for driving a rotating member about a rotation axis, thereby imparting a motive force to the children's toy, and a power supply configured for powering the drive system. According to various embodiments, the power supply is disposed within the interior area, secured in a fixed positioned with respect to the housing, and accessible through an opening in the housing. For example, in certain embodiments a door panel disposed on the housing and configured for providing selective access to the power supply.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION OF THE INVENTION

The present invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Various embodiments of the present invention are directed to a powered children's toy configured for movement along a support surface. According to various embodiments, the powered children's toy includes a drive system configured to impart a motive force on the children's toy that causes the toy to roll, shake, or otherwise move along an eccentric motion path when placed upon a support surface (e.g., a floor). As described in greater detail herein, various embodiments of the drive system are configured to drive a rotating member about a movable rotation axis, thereby generating a varying motive force that causes eccentric movement along the support surface. In particular, this varying motive force assists in freeing the toy ball from obstacles encountered on a support surface (e.g., a wall or piece of furniture). In addition, various embodiments of the powered children's toy include a power supply provided in a fixed position within the children's toy and configured for convenient user access.

Powered Toy Ball with Fixed Motor

Figure 1:
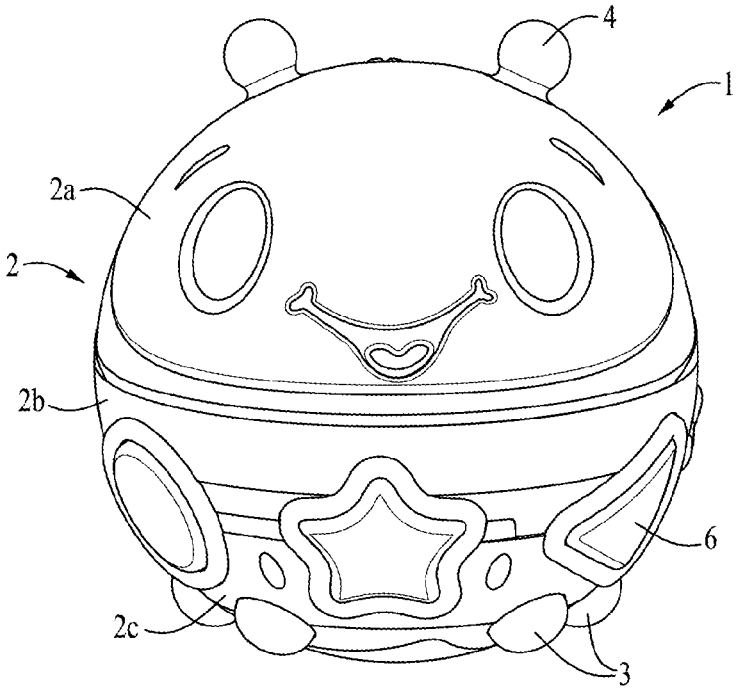
FIG. 1 shows a front view of a powered toy ball according to one embodiment of the present invention.

FIG. 1 illustrates a toy ball 1 according to one embodiment of the present invention. As shown in FIG. 1, the toy ball 1 includes a generally spherical housing 2 comprised of an upper section 2*a*, middle section 2*b*, and lower section 2*c*, which may be held together by one or more fasteners (e.g., screws or clips). As discussed later herein, the housing 2 is substantially hollow and defines an open interior area, which may be accessed by disassembling the upper section 2*a*, middle section 2*b*, and lower section 2*c*. In the illustrated embodiment of FIG. 1, the assembled housing 2 is configured to resemble a bumble bee character and is sized to have a diameter of approximately 6 inches. However, according to various embodiments, the housing 2 may comprise any number of sections and may be configured in a variety of shapes and sizes, as well as to reflect any number of child-appropriate characters or themes.

Figure 2:
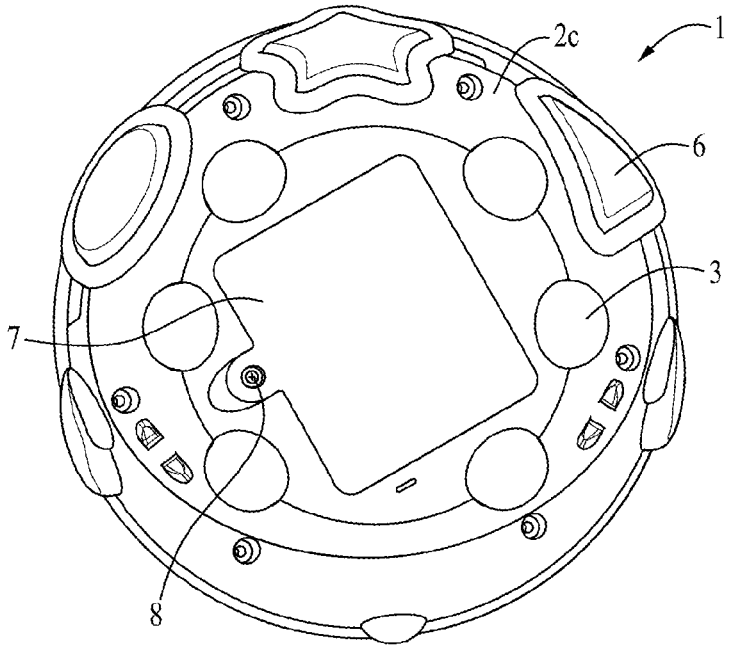
FIG. 2 shows a bottom view of the powered toy ball of FIG. 1 according to one embodiment of the present invention.

FIG. 2 shows a bottom view of the toy ball 1. As shown in FIGS. 1 and 2, the housing's lower section 2*c* includes six rounded projections 3 shaped to resemble the bee's feet. In the illustrated embodiment, the projections 3 are spaced in a generally circular pattern around the bottom of the lower section 2*c*. In addition, the housing's upper section 2*a* includes a pair of projections 4 shaped to resemble the bee's antennas. According to various embodiments, the projections 3, 4 are configured such that, as the toy ball 1 rolls on a support surface, the projections 3, 4 interrupt the ball's rolling motion and cause the ball 1 to rebound off the projections 3, 4 in various directions. As a result, the projections 3, 4 enhance the eccentric motion of the toy ball 1. In addition, the projections 3, 4 may be configured to absorb energy when the toy ball 1 is dropped onto a floor in order to protect the toy ball 1. As will be appreciated from the description herein, various other embodiments of the toy ball 1 may include any number of projections having various sizes, shapes, orientations, and locations on the exterior of the ball's housing 2. According to various embodiments, these projections may be made from a variety of rigid or soft materials (e.g., plastic, resilient rubber, foam, etc.). In addition, as discussed below, the housing 2 may be provided with or without the aforementioned projections 3, 4.

The housing 2 also includes a plurality of light assemblies 6 in order to enhance the entertainment value of the toy ball 1. The lights 6 may be configured to activate, for example, in response to the motion of the toy ball 1 and/or according to a predefined logic programmed in a control device. In addition, the toy ball 1 may include a sound emitting device (e.g., a compact speaker) configured to play songs, melodies, voices, or other sounds in conjunction with the activation of the lights 6. For example, in one embodiment, the toy ball 1 includes a controller (e.g., a processor) programmed to play various songs and activate various light patterns in accordance with a variety of predefined modes (e.g., a start-up mode, play mode, learn mode, and/or try-me mode).

As shown in FIG. 2, the housing 2 also includes a door panel 7 configured for being movable between an open position in which the panel 7 provides access to a power supply 9 (shown in FIG. 3) within the housing 2, and a closed position in which the panel 7 protects and retains the power supply 9 within the housing 2. According to various embodiments, the door panel 7 is removably secured to the housing's lower section 2*c* and shaped integrally with the curvature of the spherical housing 2. In the illustrated embodiment, the door panel 7 is removably secured to the housing 2 by a screw fastener 8 such that a user may attach or remove the door panel 7 by screwing or unscrewing the screw fastener 8. As such, a user can conveniently access the power supply 9 (e.g., to remove or replace the power supply 9). According to various other embodiments, the door panel 7 may be secured by other fastening devices and may be hinged in order to remain connected to the housing in both the opened and closed positions.

Figure 3:
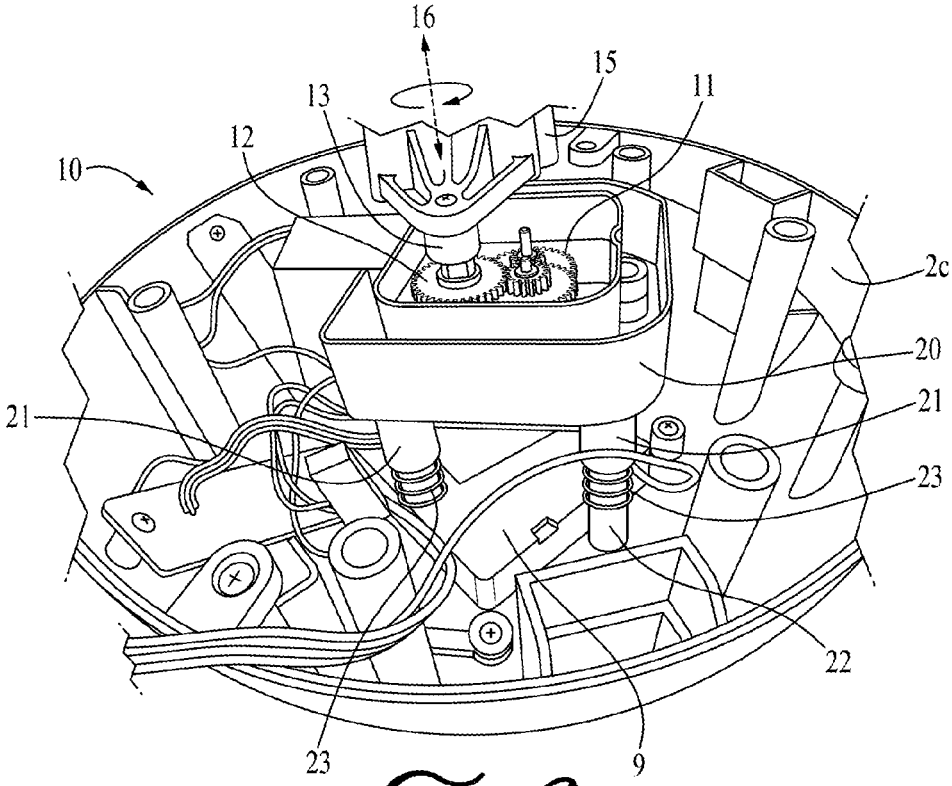
FIG. 3 shows a perspective view of a toy ball drive system according to one embodiment of the present invention.

FIG. 3 illustrates the toy ball 1 with the housing's upper and middle sections 2*a*, 2*b* removed. As shown in FIG. 3, the toy ball 1 includes an internal drive system 10 operatively connected to the housing's lower section 2*c* and configured for imparting a motive force on the toy ball 1. In the illustrated embodiment of FIG. 3, the drive system 10 comprises a motor 11 configured for driving a rotating weight 15 about a rotation axis 16. As explained in greater detail below, the motor 11 and rotating weight 15 are positioned on a platform 20 that is resiliently connected to the housing's lower section 2*c*, thereby permitting the platform 20, motor 11, and weight 15 to tilt in various directions as the weight 15 rotates about the rotation axis 16.

According to various embodiments, the motor 11 may comprise any suitably compact motor capable of generating sufficient power to drive the weight 15 about the rotation axis 16. For example, in the illustrated embodiment of FIG. 3, the motor 11 comprises an electric DC motor powered by the aforementioned power supply 9. According to various embodiments, the power supply 9 may comprise one or more removable batteries (e.g., disposable AAA sized batteries) or one or more rechargeable, fixed batteries (e.g., a lithium ion battery) positioned in an internal power supply housing. As shown in FIG. 3, the power supply 9 is positioned adjacent the housing's lower section 2*c* for easy access via the housing's door panel 7 (shown in FIG. 2).

According to various embodiments, the motor 11 is connected to a gearbox 12, and the motor 11 and gearbox 12 are positioned on the platform 20. The gearbox 12 is configured for stepping down the output speed of the motor 11, which itself can be adjusted by supplying variable amounts of voltage from the power supply 9. The power transferred from the motor through the gearbox 12 is output via a driveshaft 13 operatively connected to the gearbox 12. In the illustrated embodiment, the driveshaft 13 is oriented perpendicularly to the platform 20 and defines the rotation axis 16, which shares the same orientation with respect to the platform 20.

As shown in FIG. 3, the drive system's weight 15 is attached to the driveshaft 13 such that, as the driveshaft 13 is rotated by the motor 11, the weight 15 rotates about the rotation axis 16. As the driveshaft 13 is connected to the gearbox 12, the angular velocity of the weight 15 rotating about the rotation axis 16 is reduced from the output speed of the motor 11. In one embodiment, the weight 15 may be driven about the rotation axis 16 at speeds between 0.25 and 10 revolutions per second. According to various embodiments, the weight 15 may be comprised of one or more weighted plates. For example, in one embodiment, the weight 15 is comprised of a plurality of plates having a total weight of approximately 150 grams. However, as explained in greater detail below, the weight of plate or plates may be reduced or increased according to various other embodiments to provide a desired motion characteristic.

In the illustrated embodiment of the FIG. 3, the platform 20 is operatively connected to housing's lower section 2*c* by three compression coil springs 23 (two of which are visible in FIG. 3). In the illustrated embodiment, each of the springs 23 are positioned generally proximate to an outer edge of the platform 20. In particular, the platform 20 includes a plurality of downwardly extending legs 21, each of which is connected to an upper end of one of the springs 23. In addition, the housing's lower section 2*c* includes a plurality of upwardly extending protrusions 22, each of which is connected to a lower end of one of the springs 23. For example, in FIG. 3, the right-most visible protrusion 22 extends upwardly directly from the housing's lower section 2*c*, while the left-most visible protrusion 22 extends upwardly from a power supply housing connected to the lower section 2*c*. As a result, the platform 20 is resiliently connected to the housing's lower section 2*c* such that the platform 20 will tilt resiliently in various directions relative to the housing 2 in response to the forces exerted by the rotation of the weight 15. In addition, the motor 11, gearbox 12, drive shaft 13, and weight 15—which are operatively connected to the platform 20—will tilt with platform 20.

Figure 4:
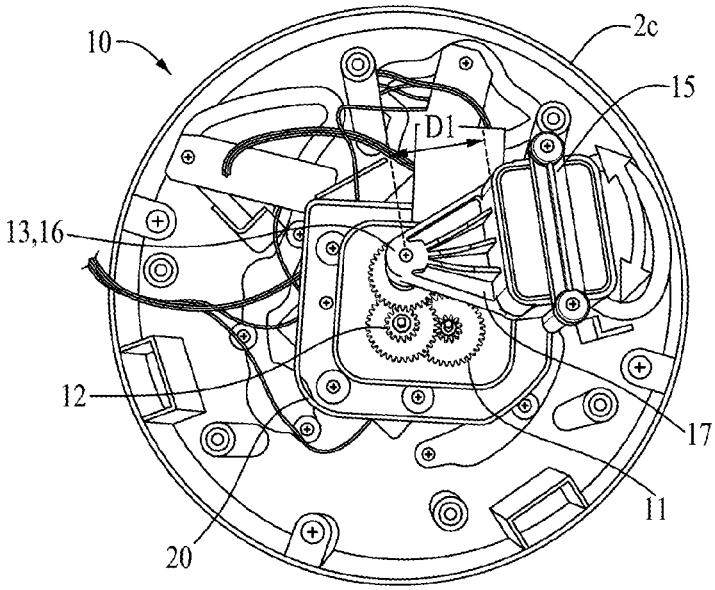
FIG. 4 shows a top view of the toy ball drive system of FIG. 3 according to one embodiment of the present invention.

FIG. 4 shows a top view of the drive system 10. In the illustrated embodiment of FIG. 4, the weight 15 is offset from the rotation axis 16 by a distance D1 (e.g., 1.875 inches). For example, in the illustrated embodiment, the weight 15 is secured to the driveshaft 13 by a mounting member 17 that holds the weight 15 at its distal end and is connected to the driveshaft 13 at its proximate end. As shown in FIG. 4, the interior area of the housing 2 is sufficiently large to permit the weight 15 to rotate about the rotation axis 16 without contacting portions of the housing 2.

According to various embodiments, as the weight 15 is rotated by the motor 11, the movement of the weight 15 produces a radially outward force that causes the platform 20 to tilt in various directions as permitted by the springs 23. As the driveshaft 13 moves with the platform 20, the position of the rotation axis 16 with respect to the housing 2 changes as the weight 15 rotates and the platform 20 tilts in various directions. This configuration permits the weight 15 to rotate along a variable path with respect to the housing 2, thereby imparting a variable motive force that causes the toy ball 1 to roll along an eccentric path on a support surface. For example, in some embodiments, the weight's 15 motion path may be conical in shape. In addition, the radial force produced by the spinning of the weight 15 is amplified by the movement of the rotation axis 16. This amplified force, which is exerted in various directions as the weight 15 rotates about the tilting rotation axis 16, provides the ball with the necessary variable throwing power to move itself away from various obstructions (e.g. walls or furniture).

According to various embodiments, the motion characteristics of the toy ball 1 may be altered by making adjustments to various components of the drive system 10. For example, adjustments in the stiffness of the springs 23, as well as the number of springs 23 connecting the platform 20 to the housing 2, will impact the degree to which the platform 20 is permitted to move relative to the housing 2. This, in turn, will dictate the motion path of the weight 15, the corresponding motive force imparted to the toy ball 1, and thereby the motion characteristics of the toy ball 1. In addition, the size and speed of the weight 15 will produce variations in the resulting movement of the toy ball 1, including rolling, bouncing, and vibration motion. For example, using a lighter weight 15 and a relatively slow motor speed will cause the toy ball 1 to roll at a low speed along a support surface, but still along an eccentric motion path. This configuration may be adapted, for example, for use with young children. In other embodiments, providing a heavier weight 15 and higher motor speed will result in quicker, more abrupt motion that may be more suitable for older children or pets. Accordingly, by adjusting the mass of the weight 15 and its rotational speed, the toy ball 1 can be configured for a desired motion characteristic.

In addition, various embodiments of the toy ball 1 may include a control system (e.g., an integrated circuit or other control device) configured to control the various features of the toy ball 1 (e.g., the motor 11, lights 6, and any sound emitting devices provided on the toy ball 1). In certain embodiments, the control system may be configured to control the motor 11 by dictating current sent to the motor 11 by the power supply 9. For example, in certain embodiments, the toy ball 1 may include a manual on/off switch connected to the control system and configured to turn the motor 11 on or off. In other embodiments, the housing 2 may include an on/off switch positioned between a pair of its sections 2*a*, 2*b*, 2*c* such that, when the housing 2 is fully assembled, the motor 11 is automatically turned on.

In addition, the control system may be programmed with a variety of settings for controlling the toy ball 1. For example, in one embodiment, the control system is configured to activate the ball's lights 6 in response to the toy ball 1 being turned on and drive the motor 11 for a short period (e.g., 1 to 2 seconds) in order to get the attention of a child. The control system may then go to an extended play mode, in which the motor 11 is driven for a longer period of time (e.g., 10 second to 10 minutes) depending on the ball's settings.

The control system may also be configured with various settings that dictate the motion characteristics of the toy ball 1. For example, in certain embodiments, the control system may be configured to intermittently power the motor 11 with pulses supplied by the power supply 9, which may vary in length (e.g., 10 miliseconds to 5 seconds) and may vary in frequency (e.g., two pulses per second, one pulse per five seconds). By varying the length and frequency of the pulses, the motion of the toy ball 1 imparted by the drive system 10 can be changed. In addition, the control system may be configured with different settings for different surfaces (e.g., carpet, hard floor), as the surface on which the toy ball 1 is placed may impact its motion.

As will be appreciated from the description herein, the configuration of various embodiments of the toy ball 1 may differ from the particular embodiments shown in FIGS. 1-4. For example, according to various embodiments, the platform 20 may be moveably connected to the housing 2 by various resilient components (e.g., one or more rubber members or other elastic components) or by various other movable components (e.g., one or more ball joints). In addition, various embodiments of the drive system 10 may be configured such that the motor 11 is directly connected to the driveshaft 13 (e.g., such that the weight 15 moves at the same speed as the motor 11). Moreover, the housing 2 may be provided in any shape suitable for movement along a support surface (e.g., a spheroid, an octahedron, a dodecahedron, a stellated dodecahedron, cube, pyramid, or other polyhedron). The exterior surface of the housing 2 may also be formed from various materials (e.g., rigid materials such as hard plastic, resilient materials such as rubber, or soft materials such as foam). In addition, the housing 2 may be provided with or without the aforementioned projections 3, 4. In particular, certain embodiments of the housing 2 may be provided without the projections 3, 4 while still achieving eccentric motion characteristics due to the motion of the drive system 10.

Powered Toy Ball with Rotating Motor

Figure 5:
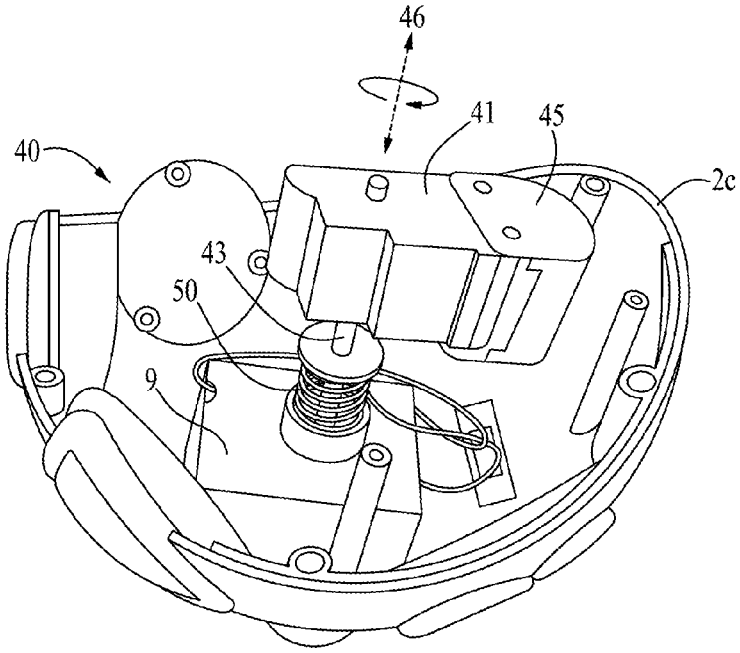
FIG. 5 shows a perspective view of another toy ball drive system according to one embodiment of the present invention.

According to various other embodiments, the toy ball 1 may include a drive system in which a weight is directly attached to a motor such that the motor and weight are configured to spin together about a driveshaft. For example, FIG. 5 illustrates an internal drive system 40 according to one embodiment. As shown in FIG. 5, the drive system 40 comprises a weight 45 secured to a motor 41 that is configured for rotating itself about a rotation axis 46. According to various embodiments, the motor 41 may comprise any suitably compact motor capable of generating sufficient power to drive itself and the weight 45 about the rotation axis 46 (e.g., the electric DC motor noted above). In the illustrated embodiment of FIG. 5, the motor 41 is powered by the above-described power supply 9.

As shown in FIG. 5, the motor 41 includes a driveshaft 43, which is operatively connected to a spring assembly 50. According to various embodiments, the driveshaft 43 is held in a fixed position relative to the spring assembly 50 such that, when the motor 41 is turned on, the motor 41 itself rotates about the driveshaft 43. For example, in the illustrated embodiment of FIG. 5, the driveshaft 43 defines a rotation axis 46 and, as such, the motor 41 rotates about the rotation axis 46. In addition, the weight 45 is affixed to the motor 41 such that the center of gravity of the motor assembly 41, 45 is offset from the rotation axis 46. As a result, a radially outward force is produced as the motor 41 and weight 45 spin about the driveshaft 43.

In the illustrated embodiment, the spring assembly 50 is secured to the housing's lower section 2*c* at a location on top of the power supply 9. The spring assembly 50 permits the driveshaft 43 and motor 41 to tilt resiliently relative to the housing. Accordingly, the driveshaft 43 is resiliently connected to the housing 2 and the rotation axis 46 is movable with respect to the housing 2.

As the motor 41 and weight 45 rotate about the driveshaft 43, the movement of the motor 41 and weight 15 produces a radially outward force that causes the driveshaft 43 to tilt in various directions as permitted by the spring assembly 50. As the driveshaft 43 moves, the position of the rotation axis 46 with respect to the housing 2 changes. This configuration permits the motor 41 and weight 45 to rotate along a variable path with respect to the housing 2, thereby imparting a variable motive force that causes the toy ball 1 to roll along an eccentric path on a support surface. In addition, the radial force produced by the spinning of the motor 41 and weight 45 is amplified by the movement of the rotation axis 46. This amplified force, which is exerted in various directions as the weight 15 rotates about the tilting rotation axis 16, provides the ball with the necessary variable throwing power to move itself away from various obstructions (e.g. walls or furniture).

Figure 6:
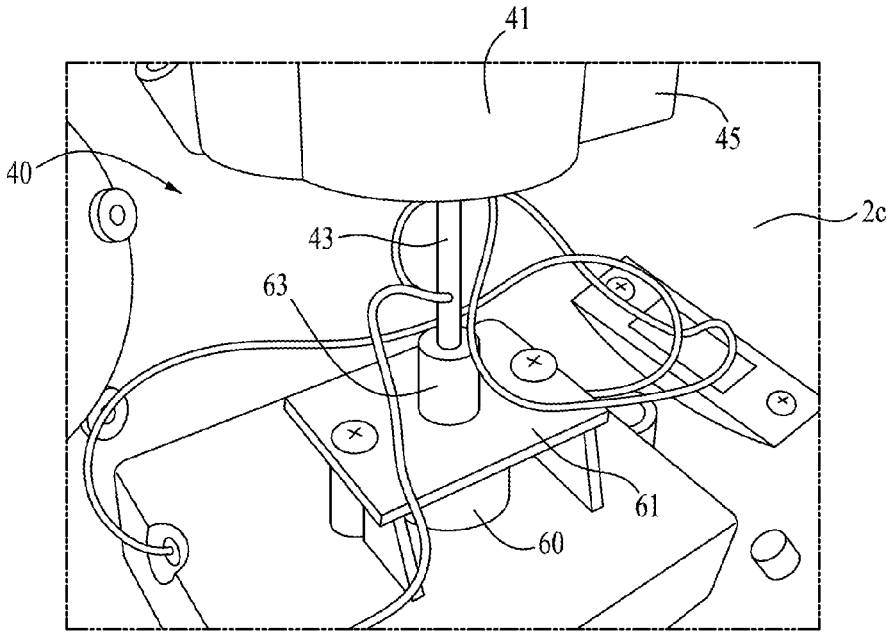
FIG. 6 shows a perspective view of yet another toy ball drive system according to one embodiment of the present invention.

FIG. 6 illustrates another embodiment of the drive system 40 in which the driveshaft 43 is secured to a ball joint assembly. In the illustrated embodiment of FIG. 6, the ball joint assembly includes a ball joint 60 rotatably positioned within a ball joint housing 61, which is affixed to the housing's lower section 2*c* on top of the power supply 9. The driveshaft 43 is secured to a joint member 63 that extends through a hole in the ball joint housing 61 and is rigidly attached to the ball joint 60. The diameter of the hole is slightly larger than that of the joint member 63 such the joint member 63 is free to move within the hole as the ball joint 60 rotates. In certain embodiments, one or more spring members may be configured to extend between the driveshaft 43 and the housing 2 so as to bias the driveshaft 43 towards the vertically upright position.

In the configuration of FIG. 6, the driveshaft 43, motor 41, and weight 45 are free to move in various directions as permitted by the ball joint assembly. Thus, the position of the driveshaft 43 (and thereby the rotation axis 46 shown in FIG. 5) is permitted to change with respect to the housing 2. This configuration permits to the motor 41 and weight 45 to rotate along a variable path with respect to the housing 2, thereby imparting a variable motive force that causes the toy ball 1 to roll along an eccentric path on a support surface. As with the embodiment of FIG. 5, the radial force produced by the spinning of the motor 41 and weight 45 is amplified by the movement of the rotation axis 46. This amplified force, which is exerted in various directions as the weight 15 rotates about the tilting rotation axis 16, provides the ball with the necessary variable throwing power to move itself away from various obstructions (e.g. walls or furniture).

As will be appreciated from the description herein, various changes and modifications to the toy ball 1 beyond those explicitly mentioned herein are contemplated as being within the scope of the present invention. Notably, it is contemplated that the orientation, shape, quantity, material and construction method of certain features of the invention may be modified. For example, the drive system 10 may be internally connected at one end to the top or bottom of the housing 2, or to any other point inside the housing 2. Additionally, the power supply 9 may be positioned at various locations within the housing permitting convenient user access. Moreover, the flexible connection between the drive system 10 and the housing 2 may be accomplished by any number of means, provided that the rotating member (e.g., the weight and/or motor) are free to rotate along a variable path. The toy ball 1 may also include user-selectable electronics which allow for the selection of varying motor speeds, light patterns, noise patterns, etc.

Conclusion

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A powered children's toy configured for movement along a support surface, the children's toy comprising:

a housing defining an interior area and configured for rolling along the support surface; and a drive system positioned within the interior area and configured for driving a rotating member about a rotation axis, wherein the drive system is configured such that the position of the rotation axis with respect to the housing changes as the rotating member rotates about the rotation axis, thereby imparting a motive force to the children's toy.

2. The powered children's toy of claim 1, wherein the motive force imparted by the drive system drives the children's toy in varying directions, thereby causing the children's toy to roll along an eccentric path on the support surface.

3. The powered children's toy of claim 1, wherein the rotating member comprises a weighted member and the drive system comprises a motor configured for driving the weighted member about the rotation axis.

4. The powered children's toy of claim 3, wherein the motor is operatively connected to a driveshaft defining the rotation axis.

5. The powered children's toy of claim 3, wherein the drive system further comprises a platform supporting the motor and the weighted member within the interior area, the platform being movably connected to the housing such that, as the weighted member rotates about the rotation axis, the platform tilts with respect to the housing.

6. The powered children's toy of claim 5, wherein the rotation axis is positioned in a fixed relationship with respect to the platform.

7. The powered children's toy of claim 5, wherein the platform is resiliently connected to the housing.

8. The powered children's toy of claim 5, wherein the platform is operatively connected to the housing by at least one ball joint.

9. The powered children's toy of claim 4, wherein the weighted member is operatively connected to the driveshaft such that the weighted member's center of gravity is offset from the rotation axis.

10. The powered children's toy of claim 6, wherein the rotation axis is oriented perpendicularly to the platform.

11. The powered children's toy of claim 7, wherein the platform is operatively connected to housing by one or more springs.

12. The powered children's toy of claim 11, wherein the platform is operatively connected to the housing by three or more springs and wherein rotation axis intersects the platform at a location in between the three or more springs.

13. The powered children's toy of claim 1, wherein the rotating member comprises a motor configured to rotate about a driveshaft defining the rotation axis.

14. The powered children's toy of claim 13, wherein the driveshaft is movably connected to the housing such that, as the motor rotates about the rotation axis, the driveshaft tilts with respect to the housing.

15. The powered children's toy of claim 13, wherein at least one weight is attached to the motor.

16. The powered children's toy of claim 14, wherein the driveshaft is resiliently connected to the housing.

17. The powered children's toy of claim 14, wherein the driveshaft is operatively connected to the housing by at least one spring.

18. The powered children's toy of claim 17, wherein the driveshaft is operatively connected to the housing by at least one ball joint.

19. The powered children's toy of claim 1, wherein the housing's exterior surface defines a spherical shape.

20. The powered children's toy of claim 1, wherein the housing's exterior surface further defines a plurality of projections.

21. The powered children's toy of claim 1, wherein the drive system further comprises a power supply disposed within the interior area and secured in a fixed positioned with respect to the housing.

22. A powered children's toy configured for movement along a support surface, the children's toy comprising:

a housing defining an interior area and configured for rolling along the support surface;

a drive system positioned within the interior area and configured for driving a rotating member about a rotation axis, thereby imparting a motive force to the children's toy; and a power supply configured for powering the drive system, the power supply being disposed within the interior area, secured in a fixed positioned with respect to the housing, and accessible through an opening in the housing.

23. The powered children's toy of claim 22, further comprising a door panel disposed on the housing and configured for providing selective access to the power supply.

24. The powered children's toy of claim 22, wherein the power supply comprises one or more removable batteries.

25. A powered children's toy configured for movement along a support surface, the children's toy comprising:

a housing defining an interior area and configured for movement relative to the support surface; and a drive system positioned within the interior area and configured for driving a rotating member about a rotation axis, wherein the drive system is configured such that the position of the rotation axis with respect to the housing changes as the rotating member rotates about the rotation axis, thereby imparting a motive force to the children's toy.

* * * * *